US005389022A

United States Patent [19]

Kobayashi

[11] Patent Number: 5,389,022

[45] Date of Patent: Feb. 14, 1995

[54] JET BOAT

[75] Inventor: Noboru Kobayashi, Iwata, Japan

[73] Assignee: Yamaha Hatsudoki Kabushiki Kaisha, Iwata, Japan

[21] Appl. No.: 976,660

[22] Filed: Nov. 16, 1992

Related U.S. Application Data

[63] Continuation of Ser. No. 798,363, Nov. 21, 1991, abandoned, which is a continuation of Ser. No. 615,980, Nov. 20, 1990, abandoned.

[30] Foreign Application Priority Data

Nov. 21, 1989 [JP] Japan ..... 1-303977

[51] Int. Cl.[6] ..... B63H 21/32; B63H 21/34; B63H 21/38

[52] U.S. Cl. ..... 440/89; 114/270

[58] Field of Search ..... 440/88, 89; 60/221, 60/222, 272, 281, 310, 317, 319–322; 181/198, 212, 220, 221, 228, 235, 241–249, 259, 260

[56] References Cited

U.S. PATENT DOCUMENTS

| | | | |
|---|---|---|---|
| 4,002,136 | 1/1977 | Michalak | 440/89 |
| 4,213,414 | 7/1980 | Sato | 440/89 |
| 4,274,357 | 6/1981 | Dawson | 440/89 |
| 4,498,876 | 2/1985 | Zemlicka | 440/89 |
| 4,589,852 | 5/1986 | Price | 440/89 |
| 4,744,778 | 5/1988 | Porter | 440/89 |
| 4,786,265 | 11/1988 | Porter | 440/89 |
| 4,840,589 | 6/1989 | Breaux | 440/89 |
| 5,007,870 | 4/1991 | Okubo et al. | 440/89 |

*Primary Examiner*—Robert J. Oberleitner
*Assistant Examiner*—Clifford T. Bartz
*Attorney, Agent, or Firm*—Knobbe, Martens, Olson & Bear

[57] ABSTRACT

A jet propulsion unit having an improved exhaust silencing device that is comprised of an expansion chamber that extends across the rear end of the tunnel and which forms a lower closure therefor. The exhaust silencing device comprises an expansion chamber through which an exhaust conduit extends from the exhaust system of the engine to an underwater exhaust gas discharge. Perforated sections of the conduit communicate the exhaust gases with the interior of the expansion chamber for silencing purposes.

15 Claims, 4 Drawing Sheets

JET BOAT

CROSS REFERENCE TO RELATED APPLICATION

This application is a continuation of my application of the same title, "Jet Boat" Ser. No. 07/798,363 filed Nov. 21, 1991, now abandoned, which application was a continuation of my earlier application of the same title, "Jet Boat" Ser. No. 07/615,980 filed Nov. 20, 1990, now abandoned.

BACKGROUND OF THE INVENTION

This invention relates to a jet boat and more particularly to an improved exhaust system for a watercraft and particularly a watercraft of the jet propelled type.

Watercraft are powered by internal combustion engines in a wide variety of manners. For example, the engine may be either an outboard mounted outboard motor or an inboard unit of either an inboard or outboard drive. In addition, many watercraft are powered by jet propulsion units which are, in turn, driven by internal combustion engines. In connection with all of these types of watercraft, there are problems in connection with the treatment of the exhaust gases. Particularly, it is important to provide an efficient discharge for the exhaust gases that will not create excess back pressure which can deteriorate engine performance but also effective silencing must be accomplished.

These problems are particularly acute in conjunction with jet propulsion units and watercraft powered by them. Two types of exhaust treatment have been proposed for discharge and silencing of exhaust gases from jet propelled watercraft. In one of these types of systems, the exhaust gases flow through one or more expansion chambers that are contained within the hull of the watercraft and then are discharge through the side of the hull at the forward end thereof. This type of arrangement does not always provide effective silencing and the discharge of the exhaust gases above the water at the forward portion of the hull gives rise to contamination or soot forming on the hull.

Another type of exhaust system for jet propulsion powered watercraft discharges the exhaust gases either into the tunnel in which the jet propulsion unit is contained, or into the water being discharge from the discharge nozzle of the jet propulsion unit. Although these types of exhaust systems avoid the unsightly contamination of the hull, there is still contamination of the hull, albeit under water and also the exhaust silencing is not fully effective.

It is, therefore, a principal object of this invention to provide an improved and simplified exhaust silencing system for watercraft.

It is a further object of this invention to provide an improved silencing system for a jet propelled watercraft.

It is a further object of this invention to provide an effective system for discharging the exhaust gases from the internal combustion engine of a jet propelled watercraft without contaminating the hull, without increasing back pressure and, at the same time, while achieving effective silencing.

SUMMARY OF TIME INVENTION

This invention is adapted to be embodied in a marine watercraft having a hull powered by an internal combustion engine having an exhaust system. A combined exhaust silencer and exhaust discharge is incorporated that comprises means defining an expansion chamber and which is adapted to be affixed to the hull in at least a partially submerged position during the operation of the watercraft. An exhaust conduit extends through the expansion chamber from an inlet communicating with the engine exhaust system and an underwater exhaust outlet. The conduit has means for communicating the exhaust gases with the interior of the expansion chamber for silencing of the exhaust gases from the engine.

DETAILED DESCRIPTION OF THE PREFERRED EMBODIMENT OF THE INVENTION

Figure 1:
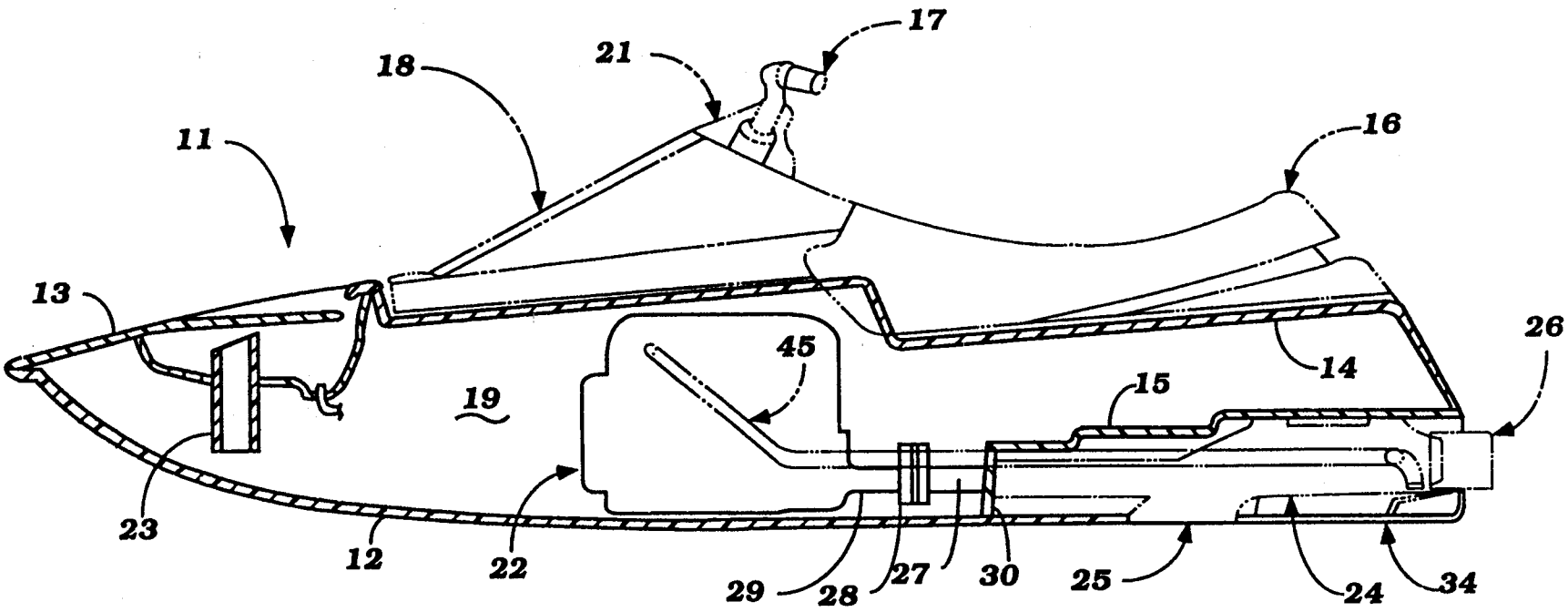
FIG. 1 is a cross sectional view taken through the hull of a small watercraft constructed in accordance with an embodiment of the invention with a portion of the watercraft being shown in phantom.

Referring first in detail to FIG. 1, a small watercraft having an exhaust silencing system constructed in accordance with an embodiment of the invention is identified generally by the reference numeral 11. The watercraft 11 is of the jet propelled type, although certain facets of the invention have application in connection with other types of watercraft and is of the type designed to be operated by a single rider seated in straddle fashion thereupon. Again, however, the invention can be utilized in conjunction with other types of jet propelled watercraft.

The watercraft 11 has a hull consisting of a lower portion 12 and a deck portion 13, each of which may be formed conveniently from fiberglass reinforced resin. The hull portions 12 and 13 are affixed to each other in a suitable manner. The deck portion 13 has a rear part that defines a step 14 that extends over a tunnel 15 positioned rearwardly at the central portion of the lower hull portion 12. A seat 16 is supported above this step 14 and is designed to accommodate a single rider seated in straddle fashion. A handlebar assembly 17 is provided at the front of the seat 16 for steering and control of the watercraft in a manner as will be described. The handlebar 17 is mounted on a cowling or hatch 18 that encloses an engine compartment 19 formed within the hull. A handlebar support 21 is formed on the hatch 18 for supporting the handlebar 17 for its steering movement.

An internal combustion engine, indicated generally by the reference numeral 22 is provided within the engine compartment 19 beneath the hatch cover 18. A front vent assembly 23 provides ventilated air for the engine compartment 19 and also induction air for the engine 22. The vent 23 is designed so as to separate water from the air that enters the engine compartment 19.

A jet propulsion unit, indicated generally by the reference numeral 24 is positioned within the tunnel 15 and has a downwardly facing water inlet 25 into which water is drawn. This water is then discharged through a pivotally supported steering nozzle 26, which is steered by the handlebar assembly 17 in a known manner for control of the steering of the watercraft. The jet propulsion unit 24 has an impeller that is driven by a drive shaft 27 that extends forwardly through a front bulk head 30 of the tunnel 15 and which is connected by means of a coupling 28 to the engine output shaft 29.

The construction of the watercraft as thus far described may be considered to be conventional and, as has been noted, the invention can be utilized in conjunction with a wide variety of watercraft.

Figure 2:
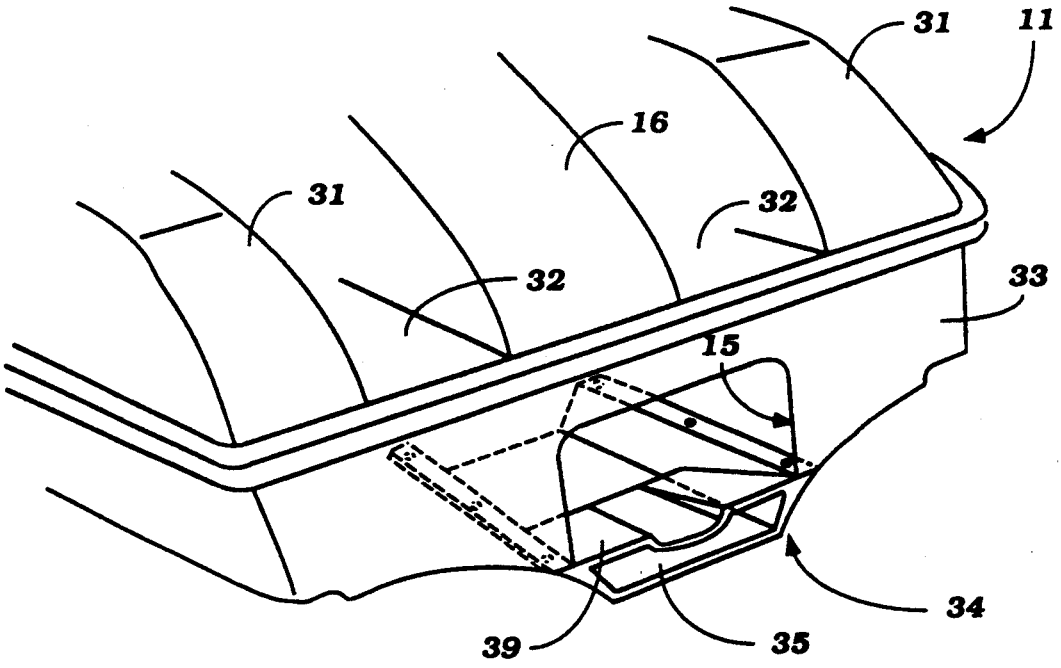
FIG. 2 is an enlarged rear perspective view showing the relationship of the exhaust silencing device with the tunnel in which the jet propulsion unit is contained and with a portion of the silencing unit removed.

It has been previously noted that the watercraft 11 in the illustrated embodiment is designed to be operated by a single rider seated in straddle fashion on the seat 16. To this end, the deck 13 is provided with a pair of raised gunnels 31 (FIG. 2) that are formed at outer peripheral sides of the hull and which define depressed foot areas 32 in which the rider's feet may be positioned. These foot areas 32 open through the rear of the transom 33 of the watercraft. In this figure, the tunnel 15 may be readily seen. Although the jet propulsion unit has been removed so as to more clearly show the construction of the exhaust silencer which forms the subject matter of this invention and which is identified generally by the reference numeral 34.

Figure 3:
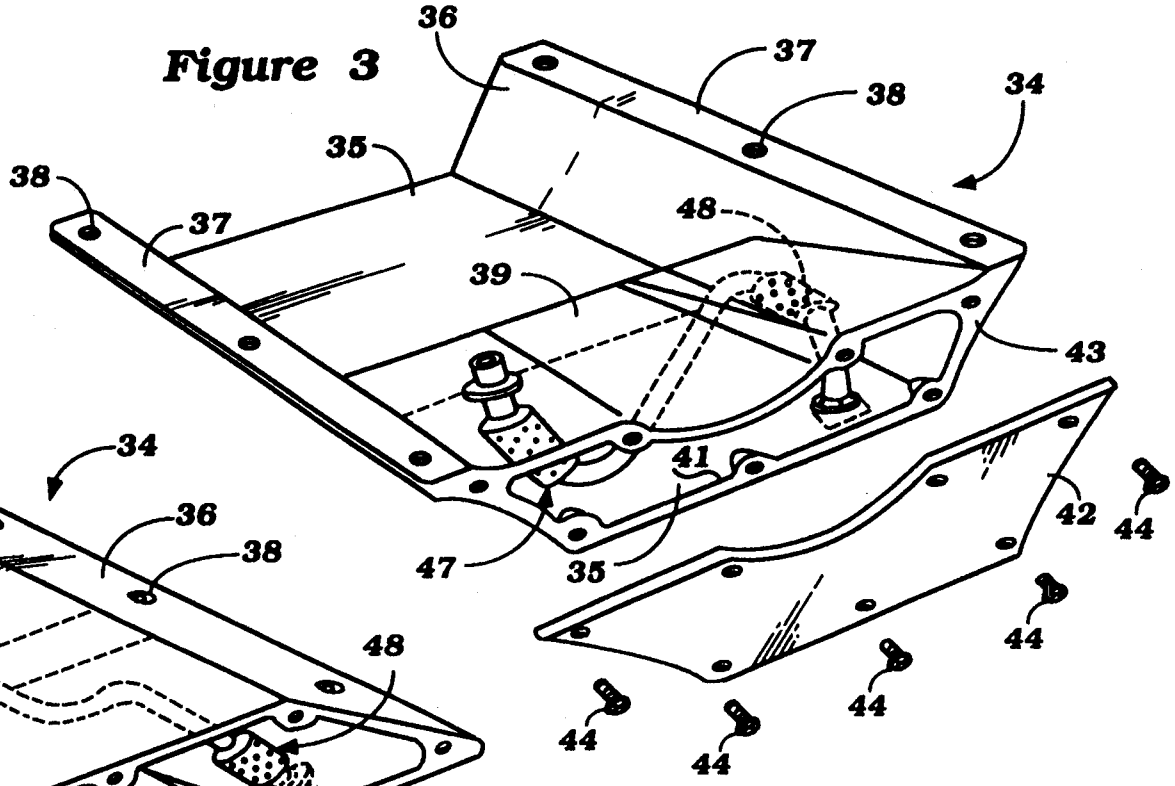
FIG. 3 is an enlarged perspective view of the exhaust silencing unit in .partially exploded form.
Figure 4:
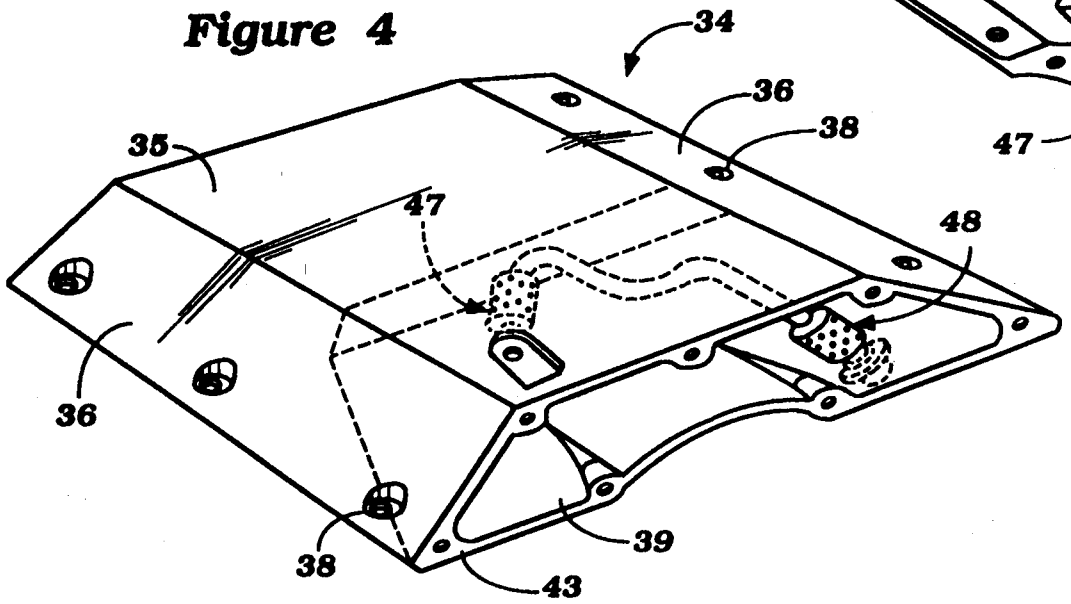
FIG. 4 is an inverted perspective view of the exhaust silencing unit with the rear cover plate removed.
Figure 5:
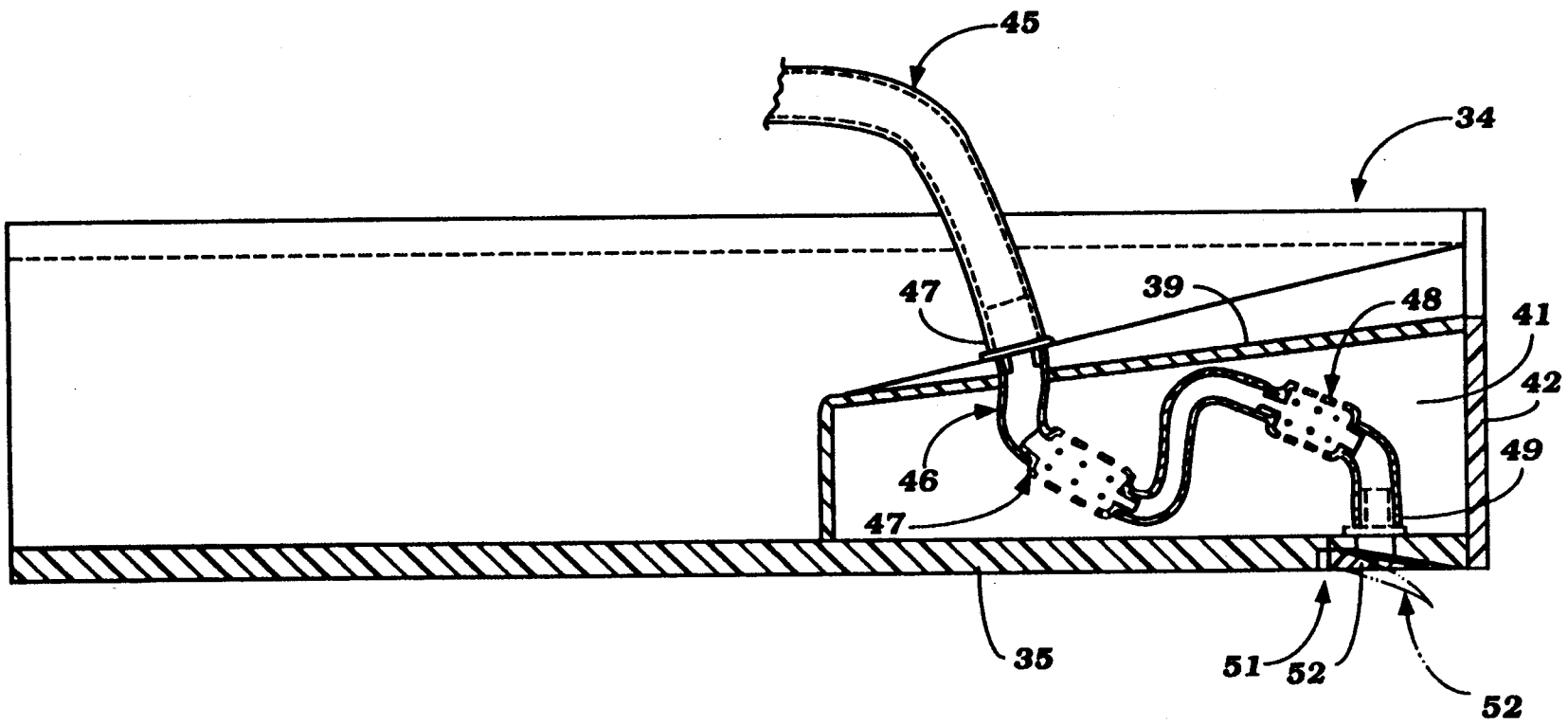
FIG. 5 is a further enlarged cross sectional view of the exhaust silencing unit as mounted in the watercraft.

The silencing device 34 is shown in most detail in FIGS. 3 through 5 and consists of a lower plate like member 35 that extends across the underside of the tunnel 15 at the rear portion thereof and thus improves the streamlining and flow resistance of the underside of the hull. In addition, this plate like member 35 may provide some reinforcing or support for the jet propulsion unit 24. A pair of angularly related side members 36 extend upwardly from the plate like member 35 and form a continuation of the configuration of the lower portion of the hull as shown best in FIG. 2. The side members 36 have generally horizontally extending flanges 37 at their upper ends in which a plurality of apertures 38 are formed so as to pass fasteners (not shown) that secure the silencer 34 to the hull and particularly the lower portion 12 thereof.

Toward the rear end of the lower plate like member 35, there is provided an angularly extending portion 39 which forms a generally trapezoidal shaped cross sectional expansion chamber, indicated by the reference numeral 41. The rear end of this expansion chamber is closed by a closure plate 42 that is held to a flange 43 at the rear portion of the assembly by means of threaded fasteners 44.

Referring again to FIG. 1, the engine 22 is provided with an exhaust system that includes an exhaust manifold and exhaust pipe 45. This exhaust pipe extends rearwardly through the engine compartment 19 and enters the tunnel 15. An exhaust conduit, indicated generally by the reference numeral 46 extends through the expansion chamber 41 from an inlet flange 47 to which the exhaust pipe 45 is affixed in a known manner. The conduit 46 is provided with a pair of perforated sections 47 and 48 that permit the exhaust gases to flow from the conduit 46 into the expansion chamber 41 and back into the exhaust conduit 46 for high frequency silencing.

An exhaust outlet opening 49 is provided in the lower portion of the plate 35 and which is normally closed by a check valve assembly, indicated generally by the reference numeral 51. The check valve assembly 51 includes a rubber flapper type valve 52 that is held in place by screws (not shown) so as to normally close the opening 49 when the engine 22 is not running. However, when the engine 22 is running, the exhaust gases will exert sufficient pressure on the flap 52 to cause it to pivot to its open position as shown in phantom in FIG. 5 and thus permit the exhaust gases to easily exit. The exhaust gases will have been silenced due to the effect of the silencer 35. In addition, the fact that the exhaust gases are discharged downwardly and beneath the jet propulsion unit 24 will provide further silencing of the exhaust gases before they are discharged to the atmosphere. This is all achieved without increasing the back pressure on the exhaust system and also without causing the hull to be soiled in any manner by the exhaust gases. In addition, a very neat configuration is provided and the silencing device 34 acts to improve the overall configuration in streamlining the hull.

It is to be understood that the foregoing description is that of a preferred embodiment of the invention and that various changes and modifications may be made without departing from the spirit and scope of the invention, as defined by the appended claims.

I claim:

1. In a marine watercraft having a hull powered by an internal combustion engine having an exhaust system, a combined exhaust silencer and exhaust discharge comprising a housing defining an expansion chamber and adapted to be affixed to and forming a portion of said hull in at least a partially submerged position during the operating of said watercraft, and an enclosed tubular exhaust conduit extending uninterruptedly through said housing and surrounded by said expansion chamber from an inlet communicating with said engine exhaust system and an underwater exhaust outlet, said tubular conduit having at least one perforated tubular section communicating the exhaust gases with the interior of said expansion chamber for silencing said exhaust gases from said engine, said expansion chamber forming a complete enclosure around the portion of said exhasut conduit passing therethrough.

2. In a marine watercraft as set forth in claim 1 further including a flapper type check valve for controlling the flow through the underwater exhaust outlet.

3. In a marine watercraft as set forth in claim 1 wherein there are a plurality of perforated sections spaced along the length of the conduit.

4. In a marine watercraft as set forth in claim 3 wherein the underwater exhaust outlet is a downwardly facing outlet.

5. In a marine watercraft as set forth in claim 4 wherein the exhaust silencer is affixed to the underside of the hull.

6. In a marine jet propelled watercraft powered by a jet propulsion unit, said watercraft having a hull having a tunnel formed at the rear of said hull and defined at its forward end by a bulkhead and at the sides thereof by side walls, and internal combustion engine, supported within said hull forwardly of said bulkhead and driving said jet propulsion unit, said jet propulsion unit being positioned at least in part within said tunnel, said engine having an exhaust system, and a combined exhaust silencer and exhaust discharge comprising means defining an expansion chamber and adapted to be affixed to the underside of said hull contiguous to said tunnel and rearwardly of said bulkhead and in at least a partially submerged position during the operation of said watercraft, and an exhaust conduit extending through said expansion chamber from an inlet communicating with said engine exhaust system and a downwardly facing underwater exhaust outlet, said conduit having a plurality of perforated sections communicating the exhaust gases with the interior of said expansion chamber for silencing said exhaust gases from said engine, said exhaust silencer being positioned at least in part beneath said jet propulsion unit, said expansion chamber forming a complete enclosure around the portion of said exhaust conduit passing therethrough.

7. In a marine watercraft as set forth in claim 6 wherein the exhaust silencer extends at least in part between the side walls of the tunnel.

8. In a marine watercraft as set forth in claim 7 further including a flapper type check valve for controlling the flow through the underwater exhaust outlet.

9. In a marine jet propelled watercraft powered by a jet propulsion unit having a water inlet through which water is drawn from the body of water in which said watercraft is operating and a discharge nozzle through which water is discharged for propelling said watercraft, and a hull having a tunnel formed at the rear of said hull and defined at its forward end by a bulkhead and at the sides thereof by side walls, an internal combustion engine, supported within said hull forwardly of said bulkhead and driving said jet propulsion unit, said engine having an exhaust system, a combined exhaust silencer and exhaust discharge comprising means defining an expansion chamber and adapted to be affixed to said hull in an area between said side walls and rearwardly of said bulkhead and at least a partially submerged position during the operating of said watercraft, and an exhaust conduit extending from an inlet communicating with said engine exhaust system and an underwater exhaust outlet disposed forwardly of said jet propulsion unit discharge nozzle, said conduit having means communicating the exhaust gases with the interior of said expansion chamber for silencing said exhaust gases from said engine, said exhaust silencer being positioned at least in part beneath the jet propulsion unit, said expansion chamber forming a complete enclosure around the portion of said exhaust conduit passing therethrough.

10. In a marine watercraft having a hull with a tunnel on the undersurface of said hull at the rear end thereof comprised of a downwardly facing opening in said hull undersurface defined by an upper wall and a pair of facing side walls which define the sides of said opening and a forward bulkhead defining the forward extent of said opening, an engine in said hull forwardly of said bulkhead and having an exhaust port, a jet propulsion unit having a water inlet through which water is drawn from the body of water in which said watercraft is operating and a discharge nozzle through which water is discharged for propelling said watercraft, said jet propulsion unit being positioned at least in part in said tunnel and driven by said engine for powering said watercraft, an exhaust silencer beneath said upper wall and having a lower surface extending beneath said side walls to form at least a partial closure for the underside of said tunnel, conduit means for delivering exhaust gases from said engine exhaust port to said exhaust silencer, said exhaust silencer defining an expansion chamber therein for silencing of the exhaust gases by expansion within said exhaust silencer, and means for delivering the exhaust gases from said exhaust silencer into the body of water in which the watercraft is operating through an underwater exhaust outlet at a point forwardly of said jet propulsion unit discharge nozzle.

11. In a marine watercraft as set forth in claim 10 further including a flapper type check valve for controlling the flow through the underwater exhaust outlet.

12. In a marine watercraft as set forth in claim 10 wherein the exhaust gases are discharged into the body of water in which the watercraft is operating.

13. In a marine watercraft as set forth in claim 12 wherein the exhaust silencer extends at least in part beneath the jet propulsion unit.

14. In a marine watercraft as set forth in claim 7 wherein the exhaust silencer extends transversely across the tunnel.

15. In a marine watercraft as set forth in claim 14 wherein the exhaust silencer is positioned at the rear portion of the tunnel.

* * * * *